US006822156B1

(12) United States Patent
Lazarus et al.

(10) Patent No.: US 6,822,156 B1
(45) Date of Patent: Nov. 23, 2004

(54) ACOUSTIC GUITAR UNDER THE SADDLE PIEZO PICKUP

(76) Inventors: Arnold M Lazarus, 81 Colton Ave., Sayville, NY (US) 11782; Arnold Lazarus, 529 Haight St., San Francisco, CA (US) 94117; Yu Hei Sunny Wai, 2282 Hastings Dr., Belmont, CA (US) 94002-3318

( * ) Notice: Subject to any disclaimer, the term of this patent is extended or adjusted under 35 U.S.C. 154(b) by 62 days.

(21) Appl. No.: 10/208,368

(22) Filed: Jul. 30, 2002

(51) Int. Cl.[7] ..... G10H 3/18
(52) U.S. Cl. ..... 84/731; 84/734
(58) Field of Search ..... 84/730, 731, 734, 84/725, 726

(56) References Cited

U.S. PATENT DOCUMENTS

| | | | | | |
|---|---|---|---|---|---|
| 4,160,401 | A | | 7/1979 | Tomioka | |
| 4,278,000 | A | | 7/1981 | Saito et al. | |
| 4,314,495 | A | | 2/1982 | Baggs | |
| 4,491,051 | A | | 1/1985 | Barcus | |
| 4,567,805 | A | * | 2/1986 | Clevinger | 84/731 |
| 4,727,634 | A | | 3/1988 | Fishman | |
| 5,123,325 | A | | 6/1992 | Turner | |
| 5,265,513 | A | | 11/1993 | Smith | |
| 5,300,730 | A | | 4/1994 | Ekhaus | |
| 5,322,969 | A | | 6/1994 | Aaroe et al. | |
| 5,877,447 | A | | 3/1999 | Vice | |
| 6,023,019 | A | * | 2/2000 | Baggs | 84/731 |
| 6,166,309 | A | | 12/2000 | Hoshino | |
| 6,198,036 | B1 | | 3/2001 | Hoshino | |

* cited by examiner

*Primary Examiner*—Marlon T. Fletcher
*Assistant Examiner*—David S. Warren
(74) *Attorney, Agent, or Firm*—Michael I. Kroll

(57) ABSTRACT

The present invention 10 has two components that provide the signal that is representative of the guitar sound, a primary pickup device 12 and a secondary pickup device 52. The primary device is the piezoelectric pickup 12 that is situated between the strings 18 beneath the saddle 14 of a stringed instrument 16. The primary device 12 is designed to detect the bulk of the sound as well as the tonal nuances. The primary device does not provide ambience. The secondary device 52 as used in one embodiment of the present invention makes use of the physically induced charge modulation properties along both the longitudinal and transverse axis of the interconnecting coax cable 52 that runs from the primary pickup 12 to the impedance changing preamplifier 36. This cable can simulate the ambience that could otherwise be generated from discrete microphones or reverberation devices. An optional pair of pickups 26 may be disposed outside the strings 18. Also, a compressible gasket 34 may be placed between the pickup 12 and saddle 14 and the pickup 12 and the bridge 22 to prevent air gaps thereinbetween.

23 Claims, 12 Drawing Sheets

ACOUSTIC GUITAR UNDER THE SADDLE PIEZO PICKUP

BACKGROUND OF THE INVENTION

1. Field of the Invention

The present invention relates generally to guitar pickups and, more specifically, to an improved acoustic guitar pickup system consisting of two components that provide the signal that is representative of the guitar sound, a primary device and a secondary device. The primary device is the piezoelectric pickup array that is situated beneath the saddle of a guitar. The device is designed to detect the bulk of the sound as well as the tonal nuances. The primary device provides minimal ambience. The secondary device makes use of the physically induced charge modulation properties along both the longitudinal and transverse axis of the interconnecting coax cable that runs from the under the saddle pickup system of the present invention to the impedance changing preamplifier to provide ambiance.

The piezoelectric elements are placed in the center between each pair of strings. A six string guitar could use five piezoelectric elements. The vibration shock wave produced by the string actuation is not directly over the piezoelectric element. The vibrations are diffused by the saddle and the offset (between the strings not directly beneath them) elements react to those diffused vibrations which also make them react to the strings vibrating sympathetically. The effect being that the transduced signal produced by the sum of the piezoelectric elements is very much like the instrument that it is installed in without the excessively percussive sound produced by piezoelectric elements placed directly below or below but adjacent to the string.

On each side of a piezoelectric element is a spacer. (See FIGS. 2, 3 and 4.) The spacer is a very important aspect of this invention as it is of a specially selected material which would provide acceptable mechanical compliance without degrading the tonal qualities of the signal. The function of the spacers is to relieve the piezoelectric elements of the total downward loading forces of the strings thus giving greater bandwidth, dynamic range and lower distortion.

It is well known that the under the saddle style pickups, which use individual piezoelectric elements, have problems that appear to be caused by partially or completely malfunctioning elements. The apparent malfunction causes the amplified acoustic guitar to sound uneven from string to string and the unevenness also changes the tonal qualities.

The reason for this malfunction may not be a failed element but a failure of the individual element to couple mechanically to the guitar. For instance, when a pickup is installed, each element may work perfectly, until the strings are tuned and tension is applied to the saddle, then one or more of the piezoelectric elements fail to be active. The reason for this and the cure, which is a subtle but important part of this invention, is as follows: the force of the string in the downward direction on the saddle is not perfectly even from string to string. The bridge and the top have some flexure, which may not be quite the same as the saddle and/or the pickup. The saddle and/or the pickup can bow just enough so that it does not sit perfectly on the pickup. The result is that the saddle bows just slightly so that the bottom of the saddle does not seat perfectly with the bridge. Any air gap at all, above or below the element, will cause the element to appear not to function.

This problem occurs whether there is a pickup installed or not because the saddle is a different material than the bridge.

Because of this, the mechanical coupling is less than perfect and affects not only the amplified sound but the acoustic sound as well. That this problem exists as defined here, is not obvious to the pickup manufacturing community which is one of the reasons why it has gone from individual elements to piezoelectric film. One solution to this problem is to use filler such as an RTV Silicon Rubber above and below the under the saddle pickup. Less than one mil (0.001 inch) is all that is needed. The problem with this system is the pickup is not easily removable. Furthermore, a void can still occur in the form of an air bubble. A better approach, as illustrated in FIG. 5, is a material, which is compressible and does not act as an adhesive, but as a compressible gasket that can easily be removed from the system and make the pickup removable as well as replaceable.

This material would do three things:

1. Prevent the mechanical decoupling of the individual piezoelectric elements of the under the saddle pickup.
2. Couple the saddle to the bridge with no void thus making the saddle drive the top more evenly resulting in a more even sound.
3. Absorbing some of the harshness due to mechanical noise of the string being actuated by the fingers or a pick.

This invention also includes an optional auxiliary pickup whose function is to detect the vibrations within the plane of the top. It adds a component that improves the tonalities of the system. The auxiliary pickup is otherwise considered part of the primary system-since the pickup is activated vibrationally.

2. Description of the Prior Art

There are other pickup devices designed for piezoelectric transducer and pickup means. Typical of these is U.S. Pat. No. 4,160,401 issued to Tomioka on Jul. 10, 1979. Another patent was issued to Saito et al. on Jul. 14, 1981 as U.S. Pat. No. 4,278,000.

Another patent was issued to Baggs on Feb. 9, 1982 as U.S. Pat. No. 4,314,495. Yet another U.S. Pat. No. 4,491,051 was issued to Barcus on Jan. 1, 1985 and still yet another was issued on Mar. 1, 1988 to Fishman as U.S. Pat. No. 4,727,634.

Another patent was issued to Turner on Jun. 23, 1992 as U.S. Pat. No. 5,123,325. Yet another U.S. Pat. No. 5,265,513 was issued to Smith on Nov. 30, 1993. Another was issued to Ekhaus on Apr. 5, 1994 as U.S. Pat. No. 5,300,730 and still yet another was issued on Jun. 21, 1994 to Aaroe et al. as U.S. Pat. No. 5,322,969.

Another patent was issued to Vice on Mar. 2, 1999 as U.S. Pat. No. 5,877,447. Yet another U.S. Pat. No. 6,166,309 was issued to Hoshino on Dec. 26, 2000. Another was issued to Hoshino on Mar. 6, 2001 as U.S. Pat. No. 6,198,036.

U.S. Pat. NO. 4,160,401

Inventor: Michiaki Tomioka

Issued: Jul. 10, 1979

A string vibration transducer bridge for an electric string instrument including a plurality of string tension mechanism provided side by side in the bridge and which are adjustably movable along the direction of the string and includes a plurality of string supporting electrode parts which are slidably movable along the direction of the string and rotatable along a direction perpendicular to the string, a plurality of independent piezoelectric transducers which each engage with an undersurface of an electrode part, and a plurality of piezoelectric transducer pushing mechanisms for pushing the piezoelectric transducers against the electrode parts whereby the tension of the string may be adjusted by both the string tension mechanism and the transducer pushing mechanism and the vibration from each string is independently sensed.

U.S. Pat. No. 4,278,000

Inventor: Shigeo Saito et al.

Issued: Jul. 14, 1981

The present invention provides a piezoelectric transducer and pickup means using the same for electrical string instruments, the transducer comprising a long and flat outer layer of flexible material and a flexible piezoelectric cable which is buried therein and has a center electrode, a piezoelectric layer formed on the outer periphery of the said electrode and an outer electrode formed on the outer periphery of the said layer, the stiffness thereof being enhanced by either using elastomer of the hardness of more than 80 as measured by the Spring Hardness Test Method in the Physical Testing Method for Vulcanizing Rubber of Japanese Industrial Standard (JIS K 6301) as the material for the outer layer, or by plaiting (braiding) metal wires or by winding the outer electrode of the piezoelectric cable in such a manner as to enable it to press against the piezoelectric layer.

U.S. Pat. No. 4,314,495

Inventor: Lloyd Baggs

Issued: Feb. 9, 1982

A piezoelectric crystal transducer defines a unitary part of a low profile saddle member adapted for interchangeable mounting in the bridge portion of a stringed musical instrument while obviating external modification of the instrument itself In a preferred embodiment of the present invention, the body of the saddle is molded or potted around elongated piezoelectric crystalline bar segments to form a unitary saddle in which the bar segments traverse the substantial length of the saddle in a direction transversely of the extension of the strings over the saddle with hook-up leads or wires extending from one end of the bar for connection to a suitable cable leading to a conventional amplifier or loudspeaker system. The transducer is constructed to respond to stresses produced by string vibrations in one or more dimensions yet is completely shielded from external electrical fields and minimizes interference with the acoustical circuit of the instrument.

U.S. Pat. No. 4,491,051

Inventor: Lester M. Barcus

Issued: Jan. 1, 1985

A string instrument pickup system sensitive to 360° of transverse string movement, which is substantially immune from microphonics, and which has a substantially equal or balanced response to all of the strings. In one form of the invention a piezoelectric transducer is compressively associated with vertical movement components of each string of the instrument, but is laterally offset from a centered position under the string for compressive association of the transducer also with the horizontal string movement components; and halves of the total piezoelectric transducer area are oppositely polarized so as to cancel out microphonics. In a modular form of the invention a plurality of the piezoelectric transducers are supported in an elongated array by means of a flexible body of electrically insulative material and a pliable outer wrapping of metal foil so that the transducer is conformable to distortions and deformations in string saddle and bridge elements of the instrument between which the modular pickup is compressed whereby the transducers are made substantially uniformly responsive to the strings. In a presently preferred embodiment a two-section split saddle and uneven transverse positioning of crystals relative to strings for each saddle section provide substantially uniform response to all of the strings; and in this embodiment extremely small crystal areas minimize capacitive signal deterioration, and transversely very short crystals improve transverse string vibration response for substantially 360 degrees of transverse string movement sensitivity.

U.S. Pat. No. 4,727,634

Inventor: Lawrence R. Fishman

Issued: Mar. 1, 1988

A transducer for a stringed musical instrument incorporating an electrically conductive ground plane, along with a plurality of piezoelectric transducers and a conductive strip. The ground plane, piezoelectric transducers and conductive strip are secured in an elongated unitary structure with the ground plane and conductive strip disposed on opposite sides of the transducers. A conductive shield made of paper with a conductive coating is disposed about the unitary structure and electrical leads connect to the ground plane and conductive strip, respectively.

U.S. Pat. No. 5,123,325

Inventor: Robert A. Turner

Issued: Jun. 23, 1992

An electro-mechanical pickup for a stringed musical instrument, such as a guitar, fits in the bottom of the saddle slot of the instrument and provides an electrical output signal representing the vibrations of the strings of the instrument. The electrical output of the transducer is generated by a piezoelectric transducer element having a long, narrow piece of piezoelectric film with an electrode on each face. One electrode of the piezoelectric transducer element is attached to the conductive face of an elongated core. One conductor of a two-conductor electrical output lead is also attached to the conductive face of the core. The core provides electrical contact and a strong mechanical attachment for the output lead. A conductive contact strip is attached to the second electrode of the piezoelectric transducer element, and the second conductor of the output lead is attached to the contact strip. In a variation of the pickup, the second electrode covers substantially all of one face of the transducer element, and the piezoelectric transducer element is wrapped completely around the core with its first electrode attached to the conductive face of the core. Wrapping the transducer element around the core enables the insulating piezoelectric film to provide insulation for the pickup, and enables the second electrode to provide electrical shielding for the pickup, which saves using additional components to provide insulation and shielding. Further variations provide additional electrical output signals, and include an additional piezoelectric transducer element connected to reduce top noise.

U.S. Pat. No. 5,265,513

Inventor: Theodore A. Smith

Issued: Nov. 30, 1993

A sound-enhancing insert for stringed instruments in general and for guitars, in particular. The insert is readily mountable between the string supporting bridge saddle and the string tie-down members without repair, alteration of, or replacement of instrument parts. One or more rigid members, constructed of metal, wood, rigid plastic or ceramic, are mounted with a top surface of the rigid member contacting a respective string and the bottom surface of the rigid member contacting the sound table of the instrument. The rigid members are preferably mounted within a pliant soft plastic material such as Neoprene for supporting the rigid members in place and making the insert adaptable to different string heights. The rigid members, in their engagement between string and sound table, provide a second reverberation signal, a change in sustain, and a change in timbre, depending upon the particular material used.

U.S. Pat. No. 5,300,730

Inventor: Ira B. Ekhaus

Issued: Apr. 5, 1994

A musical device comprises a guitar with a neck and a plurality of strings. A pickup produces electrical output signals related to the frequency and amplitude of vibration of at least one of the strings. An electronic musical effect generator is receptive of the electronic output signal for altering the frequency and amplitude to produce a musical effect. A strain gauge assembly for plurality of axes is disposed on the guitar neck to sense a plurality of axes of strain in that position during use of the instrument. A pick is actuatable by a user for initiating a note on the guitar. A second sensor senses the manual actuation pressure on the pick and another strain gauge assembly for a plurality of axes is disposed on the pick and generates a plurality of control signals corresponding to structural deflections generated during the use of the pick. A controller is responsive to outputs of the sensors for effecting an alteration in the electronic musical effect generator in response to actuation pressure and strain.

U.S. Pat. No. 5,322,969

Inventor: Kenneth T. Aaroe et al.

Issued: Jun. 21, 1994

The piezoelectric transducer saddle of the present invention is a thin, generally rectangular member that is designed to fit into the bridge slot of a musical instrument such as a guitar. The piezoelectric element is oriented vertically in the saddle and constitutes a structural member of the saddle. I n a first embodiment of the saddle, a piezoelectric element forms the saddle itself. Electrical contacts are engaged to the sides of the piezoelectric element to produce electrical output. A preferred embodiment of the saddle is a laminated structure wherein the laminated layers are disposed vertically, and a vertical layer composed of a piezoelectric material is generally centrally disposed within the laminated structure. A metallic electrical contact is engaged on each side of the piezoelectric material to receive electrical signals generated by the piezoelectric material. In one embodiment, one of the electrical contacts is formed as a metallic layer which rises to the upper surface of the saddle to make contact with the strings of the musical instrument, in order to provide a ground for the metallic musical strings of the instrument. Further embodiments of the present invention utilize multiple piezoelectric elements and shaped piezoelectric elements to produce enhanced performance.

U.S. Pat. No. 5,877,447

Inventor: Robin D. Vice

Issued: Mar. 2, 1999

The signal from a piezo-electric transducer in an electro-acoustic guitar is modified by a variable depth notch filter. The notch filter includes two paths between an input and a summation circuit. The signals in the two paths are 180 degrees out of phase and one of the paths includes a bandpass filter. The notch is located at approximately 5 khz. The depth of the notch depends upon either the broadband amplitude or the narrowband amplitude of the signal from the transducer and the depth of the notch is controlled using either feedback or feed forward control.

U.S. Pat. No. 6,166,309

Inventor: Yoshihiro Hoshino

Issued: Dec. 26, 2000

In a bridge mechanism for a guitar, the bridge main body having a recess for the saddle and an intermediate member between at least one side of the saddle and the recess. A respective recess or concave primarily in the intermediate member directly beneath where each string passes the saddle, and second regions between the depression where the intermediate member contacts the saddle, thereby to reduce transmission of vibration of the strings to the bridge body and direct the vibrations to a pick up disposed below the saddle. In alternate embodiments, the depressions are on the saddle, there is an intermediate member on both sides of the saddle. All the depressions are in the surfaces of the recess facing the saddle.

U.S. Pat. No. 6.198,036

Inventor: Yoshihiro Hoshino

Issued: Mar. 6, 2001

An electric guitar which is equipped with a piezo pickup wherein the lengths of the strings are not changed by the rotation of the main saddle body in connection with fine tuning and during tremolo performance. The electric guitar has a piezo pickup and has a main saddle body that is held so as to be rotatably adjustable in a back and forth direction about an axle. The main saddle body is held pivotally by a saddle holding member on a base plate on the guitar body. The base plate is installed so as to freely swing with respect to the surface of the guitar body to provide a tremolo effect. The top surface of the piezo pickup constantly contacts the string that is held by the main saddle body, at least during fine tuning, by rotatable adjustment of the main saddle body and in the possible swinging range of the base plate during a tremolo performance, thereby avoiding an out of tune situation during the tremolo performance.

While these acoustic guitar pickup devices may be suitable for the purposes for which they were designed, they would not be as suitable for the purposes of the present invention, as hereinafter described. The present invention, an improved acoustic guitar pickup system consisting of piezoelectric elements that are placed in between each pair of strings. A six string guitar would use five piezoelectric elements. The vibration shock wave produced by the string actuation is not directly over the piezoelectric element. The vibrations are diffused by the saddle. The offset (between the strings not directly beneath them) piezoelectric elements react to those diffused vibrations which also makes them react to the strings vibrating sympathetically. The resulting effect being that the transduced signal produced by the sum of the piezoelectric elements is very much like the instrument that it is installed in without the excessively percussive sound produced by piezoelectric elements placed directly below or below but adjacent to the string.

A further embodiment would include a piezoelectric element outside of either or both of the outer strings the distance being one half of the distance between the inner strings.

This invention is not limited to acoustic guitars. The principles and claims therein could be applicable to other musical instruments.

SUMMARY OF THE PRESENT INVENTION

The improved acoustic guitar pickup system has two components that provide the signal that is representative of the guitar sound, a primary device and a secondary device. The primary device is the piezoelectric pickup that is situated beneath the saddle of a guitar. The device is designed to detect the bulk of the sound as well as the tonal nuances. The primary device does not provide ambience. None of the pickup devices that are positioned under the saddle provide significant ambience by themselves. The two methods commonly used to add ambience is the use of one or more microphones and/or by electronic or mechanical means such as a reverberation system. The-secondary device as used in one embodiment of the invention makes use of the physically induced charge modulation properties along both the longitudinal and transverse axis of the interconnecting coax cable that runs from the pickup to the impedance changing preamplifier. This cable, carefully chosen for qualities that enhance, but not overpower the primary signal, can simulate the ambience that could otherwise be generated from discrete microphones or reverberation devices. It has been determined empirically that the ambience provided is proportionately chosen so its acoustic effect is present without forcing the system into feedback condition, as any kind of microphone is greatly prone to do so, unless operated in a highly controlled manner.

These different sounds that are generated inside the guitar are picked up by the coaxial cable that connects the pickup to the preamplifier by modulating the sound signal from the pickup to create a sound that is more pleasing and representative of the original instrument as well as an appearance of ambience (spatial effect). In addition, the use of this form of intrinsic ambient modulation does not restrict the true dynamic range nor introduce phase distortion and frequency response aberrations that are inherent with the use of external microphone and equalization techniques.

The placement of the piezoelectric elements along with the construction of the selected spacer materials combines to produce another highly desirable property: very high rejection of acoustic feedback. The present invention exhibits a pronounced and measurable "directional coupling" effect. Sound and vibration generated by the strings and the body of the guitar are strongly coupled to the transducer generating high signal levels, while sounds and vibration that are external to the guitar are weakly coupled to the transducer thus generating very low signal levels. This property allows the present invention to play much louder than existing "Under The Saddle" pickups without encountering acoustic feedback. This property has been demonstrated repeatedly.

A primary object of the present invention is to provide an improved acoustic guitar pickup system consisting of piezoelectric elements that are placed in the center between each pair of strings.

Another object of the present invention is to provide an improved acoustic guitar pickup system that the vibration shock wave produced by the string actuation is not directly over the piezoelectric element.

Yet another object of the present invention is to provide an improved acoustic guitar pickup system that consists of two components that provide the signal that is representative of the guitar sound, a primary device and a secondary device.

Still yet another object of the present invention is to provide an improved acoustic guitar pickup system that the primary device is the piezoelectric pickup that is situated beneath the saddle of a guitar. The device is designed to detect the bulk of the sound as well as the tonal nuances.

Another object of the present invention is to provide an improved acoustic guitar pickup system that the secondary device makes use of the physically induced charge modulation properties along both the longitudinal and transverse axis of the interconnecting coax cable that runs from the under the saddle pickup system of the present invention to the impedance changing preamplifier in order to provide an ambient effect.

Still yet another object of the present invention is to provide spacers of a material having acceptable mechanical compliance which would relieve the total string forces of the saddle on the piezoelectric elements in order to provide greater bandwidth, dynamic range and lower distortion.

Additional objects of the present invention will appear as the description proceeds.

The present invention overcomes the shortcomings of the prior art by providing an improved acoustic guitar pickup system consisting of piezoelectric elements that are placed in the center between each pair of strings. A six string guitar would use five piezoelectric elements. The vibration shock wave produced by the string actuation is not directly over the piezoelectric element. The vibrations are diffused by the saddle and the offset (between the strings not directly beneath them) elements react to those diffused vibrations which also makes them react to the strings vibrating sympathetically. The effect being that the transduced signal produced by the sum of the piezoelectric elements is very much like the instrument that it is installed in without the excessively percussive sound produced by piezoelectric elements placed directly below or below but adjacent to the string.

Another embodiment to further enhance the acoustic sound is to add an auxiliary pickup specifically to detect the transverse vibrations within the plane of the guitar top.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
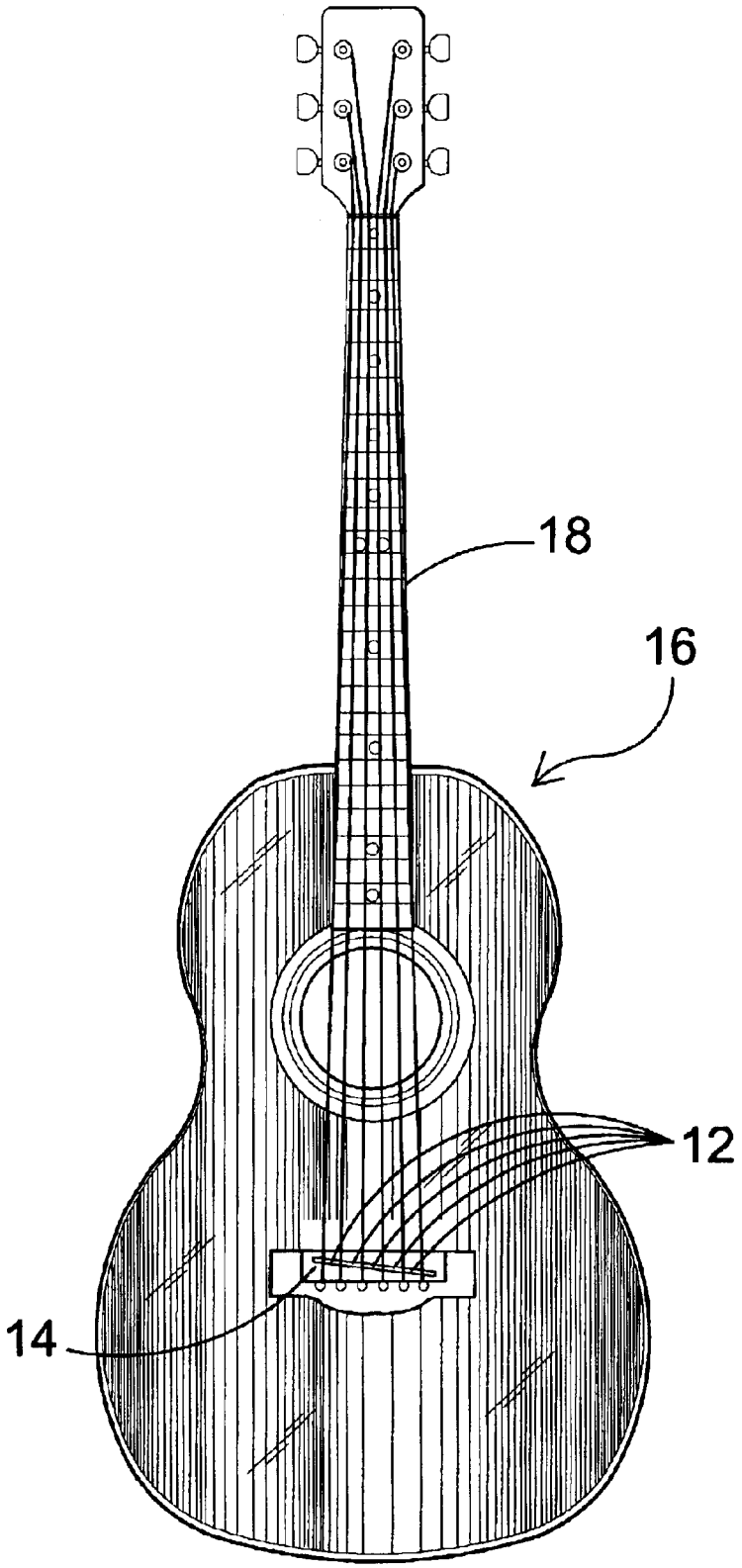
FIG. 1 is a frontal view of the present invention in use.

With regard to reference numerals used, the following numbering is used throughout the drawings.

10 present invention
12 primary piezoelectric element
13 under the saddle pickup
14 saddle
16 acoustic instrument
18 strings
19 string ball end
20 spacers
22 bridge
24 pegs
26 optional piezoelectric element
28 guitar top
30 saddle above bridge
32 saddle in saddle groove
34 compound or gasket
36 preamp
38 output jack
40 power source
42 piezoelectric ceramic
44 electrode 1
45 electrode 2
46 electrode integrator 1
47 electrode integrator 2
48 shield
50 insulator
52 coaxial cable
54 coaxial cable dielectric

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For a definition of the complete scope of the invention, the reader is directed to the appended claims.

Turning to FIG. 1, shown therein is a frontal view of the present invention 10 in use. The device of the present invention 10 is placed under the saddle 14 of an acoustic guitar or like instrument 16. A primary piezoelectric element 12 is set in the center, between each pair of strings 18. A six-string guitar as shown in FIG. 1, would use five piezoelectric elements 12, one between each string 18.

Figure 2:
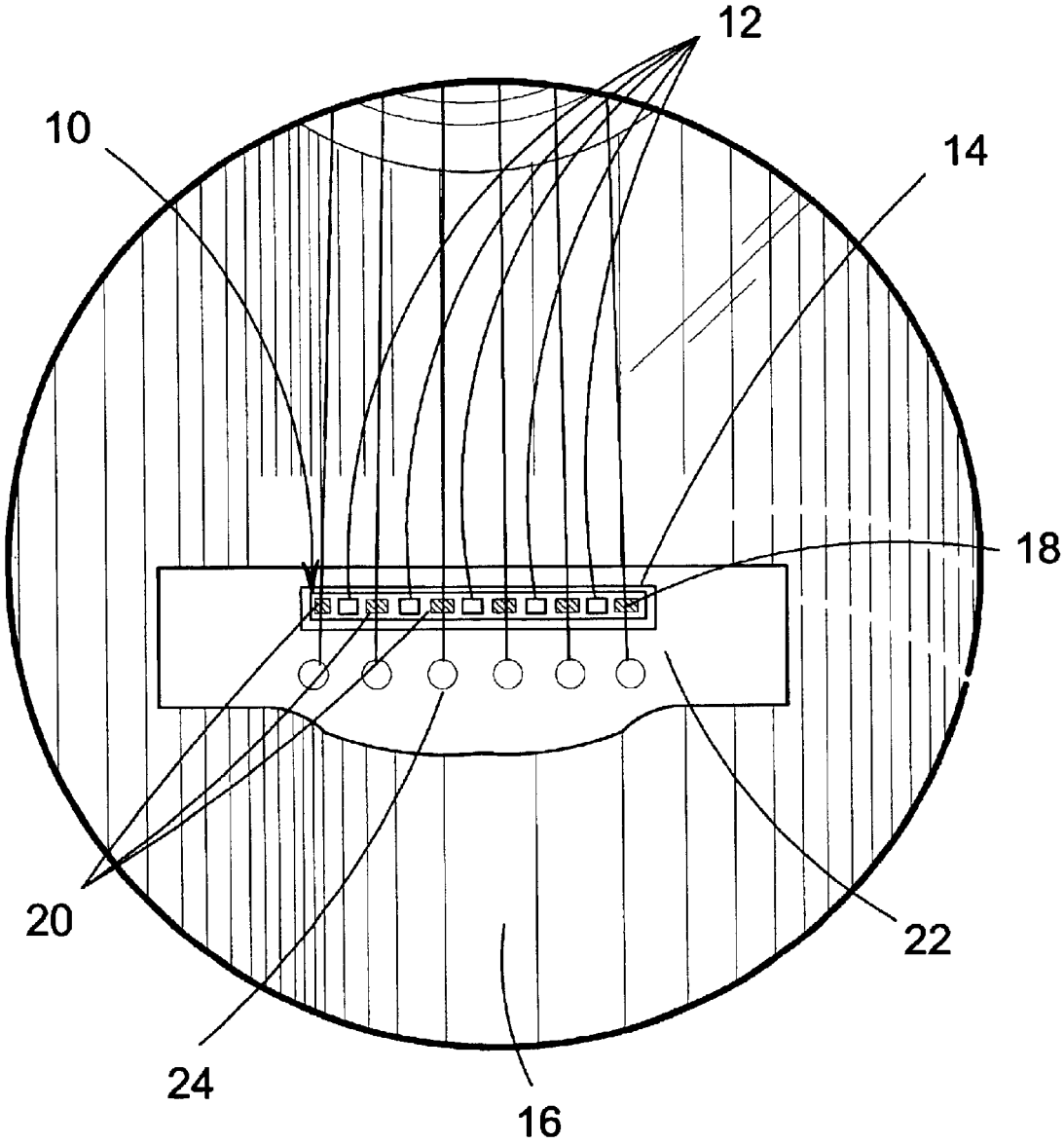
FIG. 2 is an x-ray like top view of the present invention.

Turning to FIG. 2, shown therein is an (x-ray) like top view of the present invention 10. The pickup device of the present invention is designed so that a vibration shock wave produced by the string actuation is not directly over the piezoelectric element 12. The vibrations are diffused by the saddle 14 and the offset (by being placed between the strings not directly beneath them) of elements 12 which react to those diffused vibrations which also make them react to the strings 18 vibrating sympathetically. The effect being that the transduced signal produced by the sum of the piezoelectric elements 12 is very much like the instrument 16 that it is installed in without the excessively percussive sound produced by piezoelectric elements placed directly below or below but adjacent to the string 18. Shown also are the force relieving spacers 20. Also shown are the guitar bridge 22 and the multiple string retaining pegs 24.

Figure 3:
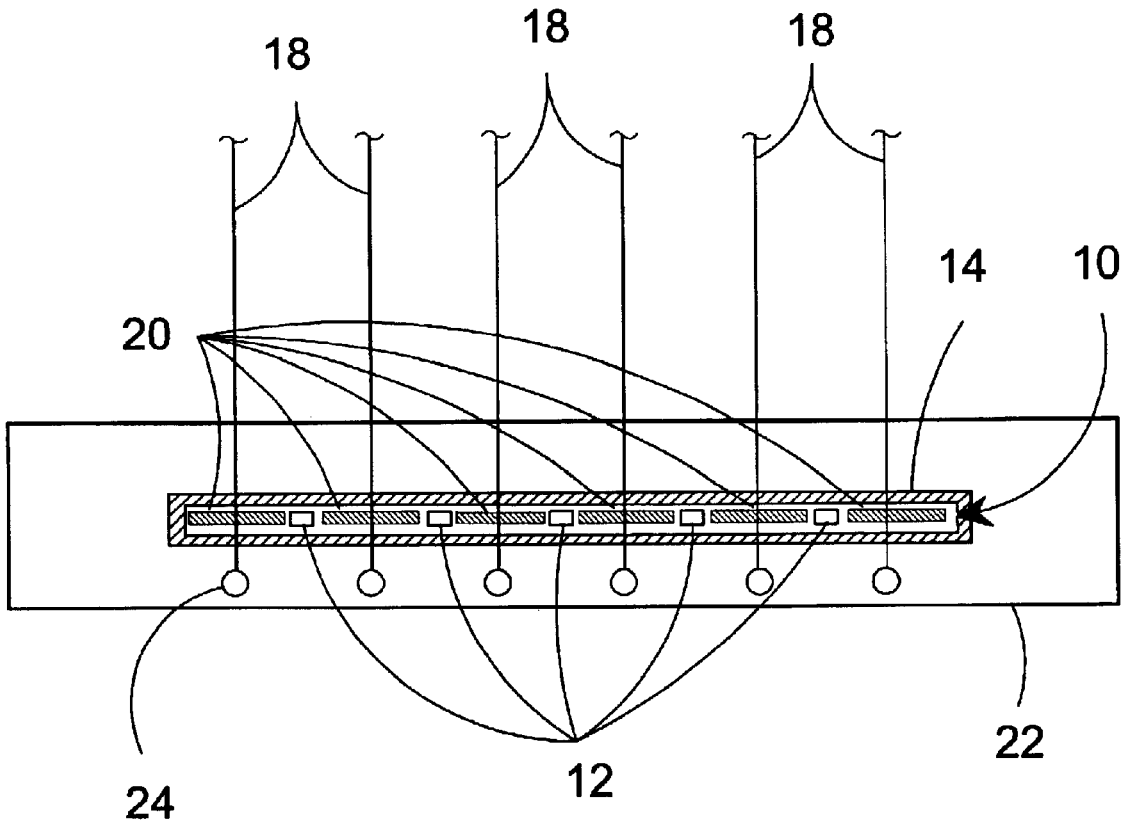
FIG. 3 is an enlarged (x-ray) view of the present invention.

Turning to FIG. 3, shown therein is an enlarged (X-Ray) view of the present invention 10. Shown is the under the saddle pickup of the present invention 10 and the position of the five piezoelectric elements 12 as well as the spacers 20. Also shown are the strings 18, string retaining pegs 24, saddle 14 and bridge 22.

Figure 4:
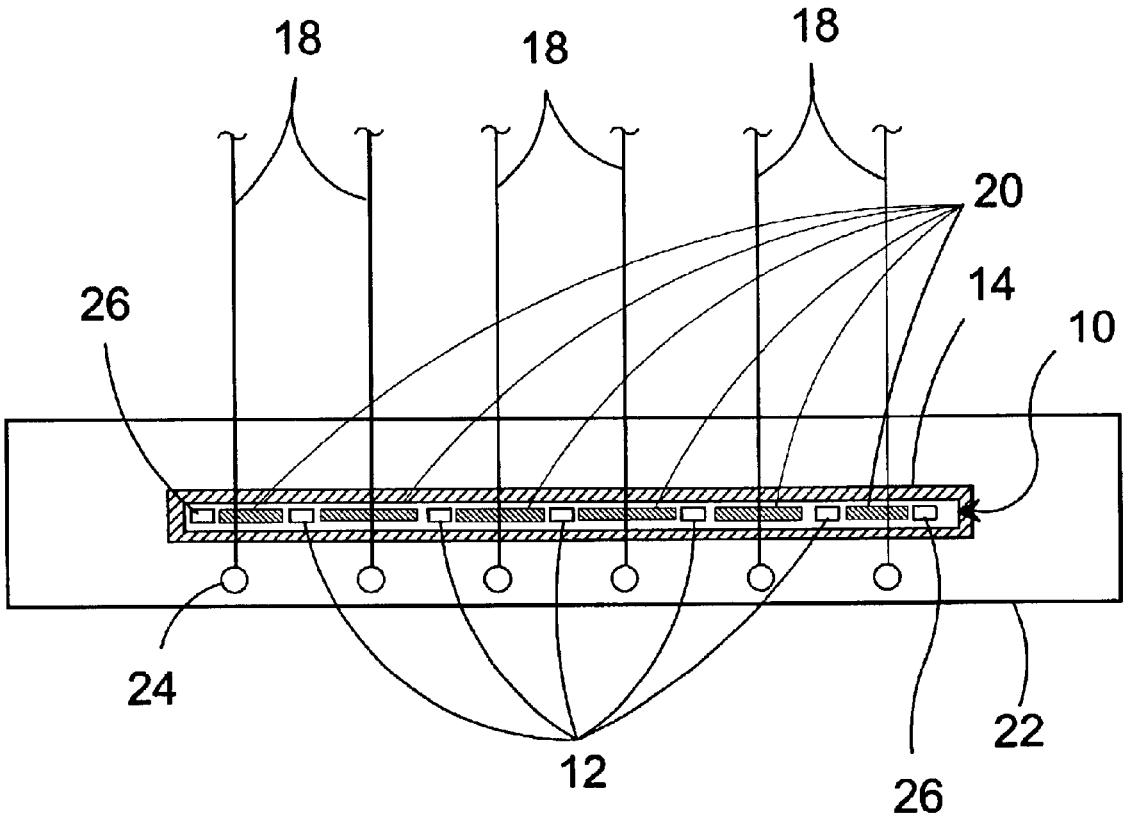
FIG. 4 is an enlarged (x-ray) view of the present invention with optional piezoelectric elements.

Turning to FIG. 4, shown therein is an enlarged (X-Ray) view of the present invention 10 with optional piezoelectric elements 26. Shown is the under the saddle pickup of the present invention 10 and the position of the five piezoelectric elements 12 and two optional piezoelectric elements 26 which may be outside of either or both outer strings, the distance being one half of the distance between the inner strings. Also shown are the strings 18, spacers 20, saddle 14, peg 24 and bridge 22.

Figure 5:
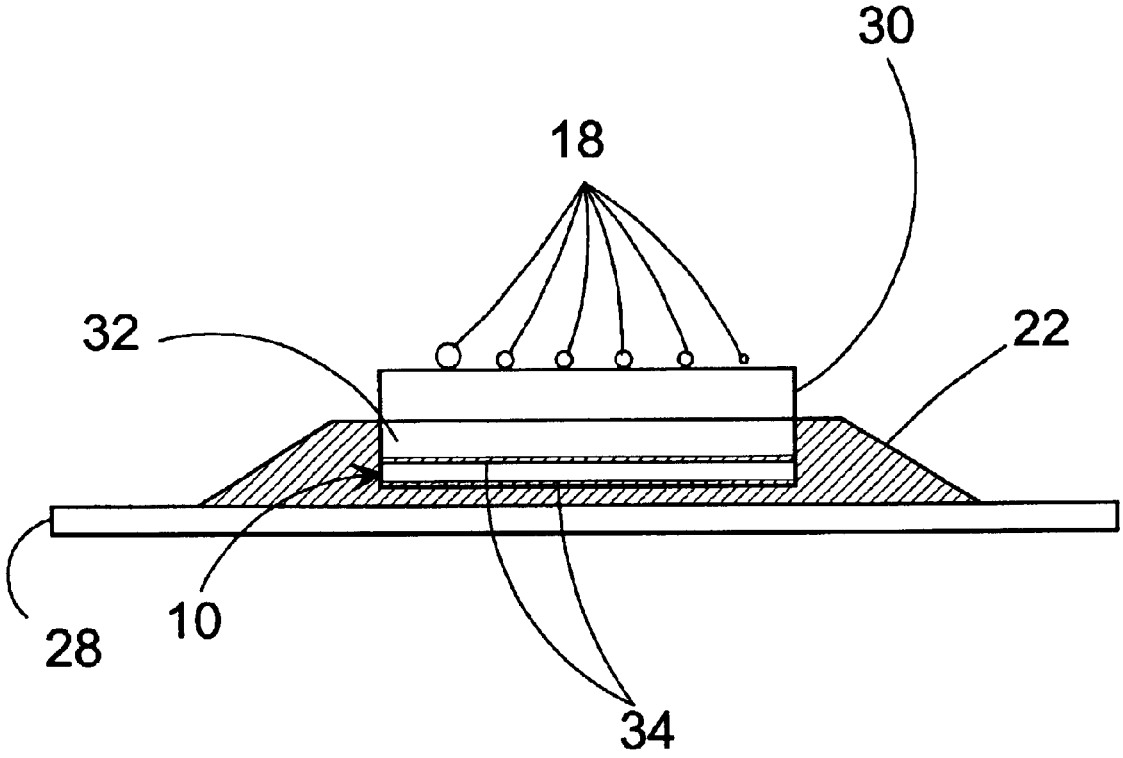
FIG. 5 is a sectional view of the present invention.

Turning to FIG. 5, shown therein is a sectional view of the present invention 10. Shown is the device of the present invention 10 with the use of the downward force compensation compound 34 for acoustically coupling the under the saddle pickup 10 to a guitar. Shown are the bridge 22, strings 18, guitar top 28, portion of saddle above the bridge 30, portion of saddle in the saddle groove of bridge 32, compound 34 which is the downward force compound shown filling the voids between the upper side of the pickup and saddle and between the bridge and the lower side of the pickup to prevent air gaps and provide an improved mechanical coupling between the saddle and bridge. Material 34 which is compressible and does not act as an adhesive, but as a compressible gasket that can be easily removed from the system and make the pickup removable as well as replaceable. This material would do three things: 1) Prevent the mechanical decoupling of the individual piezoelectric elements of the under the saddle pickup; 2) Couple the saddle to the bridge with no void thus making the saddle drive the top more evenly resulting in a more even sound; and, 3) Absorbing some of the harshness due to mechanical noise of the string being actuated by the fingers or a pick.

Figure 6:
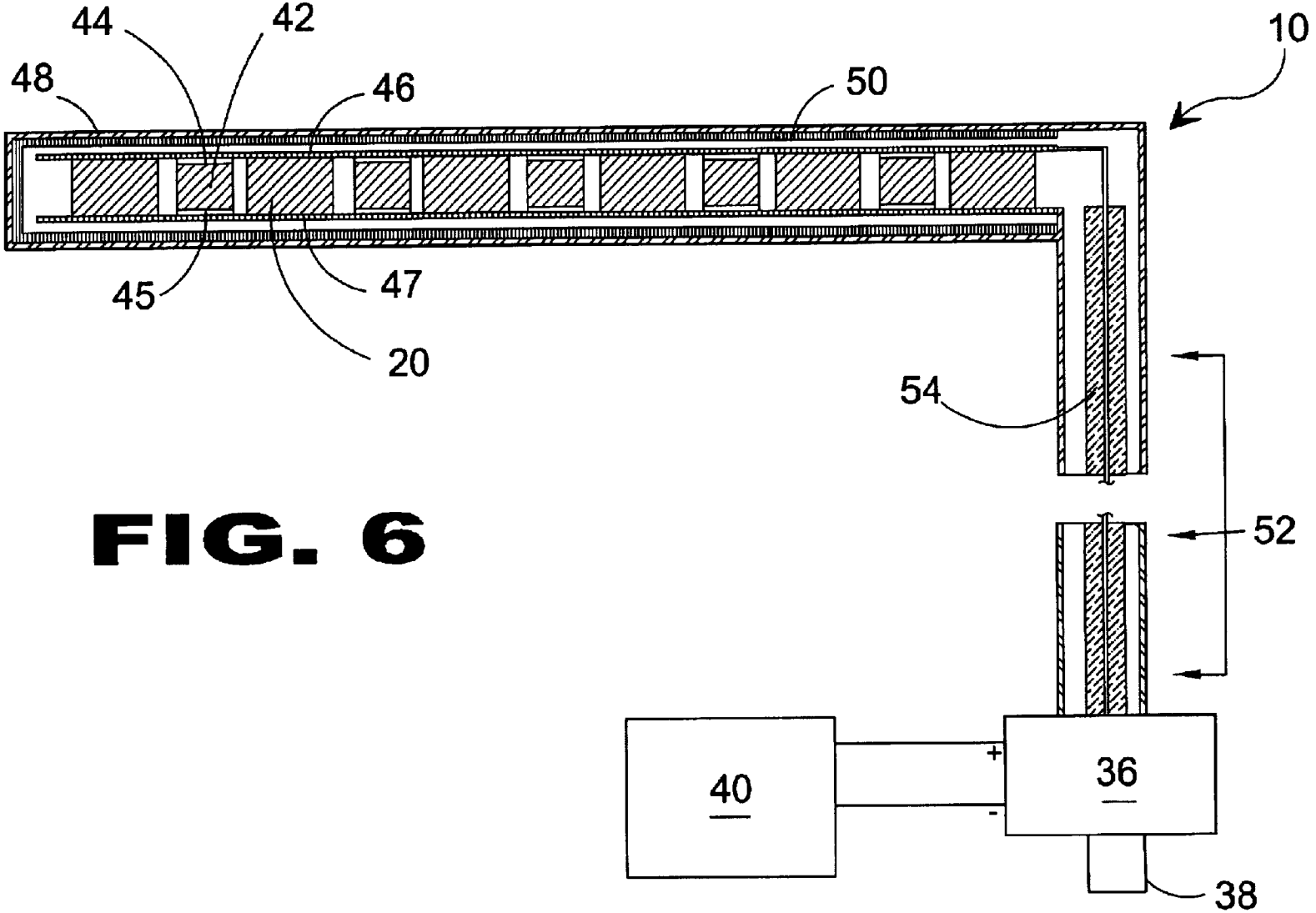
FIG. 6 is a view of the basic construction of the present invention.

Turning to FIG. 6, shown therein is a view of the basic construction and components of the present invention 10. The preamp 36 can be integral with the output jack 38 or the two discrete entities; i.e., the primary and secondary devices. The output jack 38 is also capable of switching the DC power source 40 on or off by the insertion of a plug in the jack 38. Also shown are the piezoelectric ceramic components 42, and associated first electrode 44 and second electrodes 45, first electrode integrator 46 and second electrode integrators 47, shield 48, spacer 20, insulator 50, coaxial cable and secondary sound source 52 and coaxial cable dielectric 54. The first electrode 44 and first electrode integrator 46 are opposite in polarity from the second electrode 45 and second electrode integrator 47. The output jack would permit connection to any of several types of electrical output lines for further manipulation of the output signal.

Figure 7:
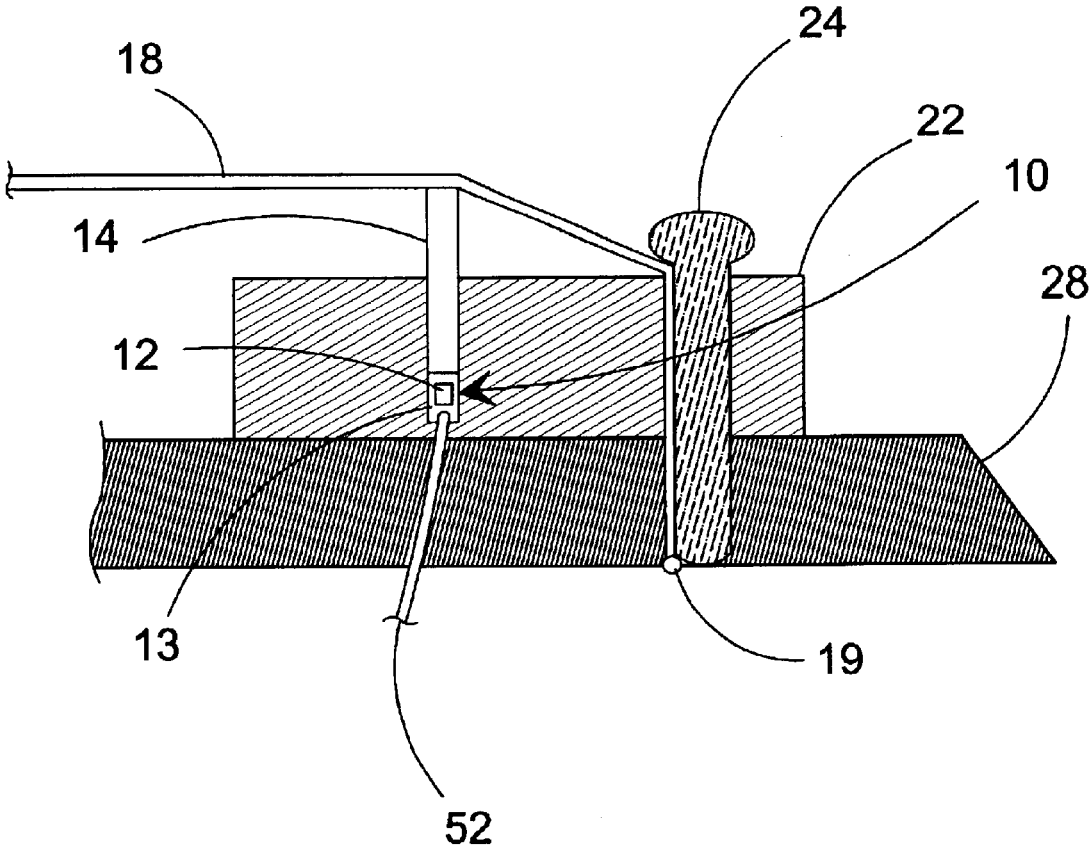
FIG. 7 is a side view of the present invention.

Turning to FIG. 7, shown therein is a side view of the present invention 10. The pickup device of the present invention 10 functions in the following manner, vibration "shock wave" produced by string 18 actuation is not directly over the piezoelectric element 12. The vibrations are diffused by the saddle 14 and the offset (between the strings not directly beneath them) elements react to those diffused vibrations which also make them react to the strings 18 vibrating sympathetically. The effect being that the transduced signal produced by the sum of the piezoelectric elements 12 is very much like the instrument that it is installed in without the excessively percussive sound produced by piezoelectric elements placed directly below or below but adjacent to the string 18. Also shown are peg 24, bridge 22, guitar top 28, the under the saddle pickup 13, string ball end 19, and coaxial cable 52 connecting the under the saddle pickup 13 to the preamp as well as functioning as a secondary (ambient) sound source.

Figure 8:
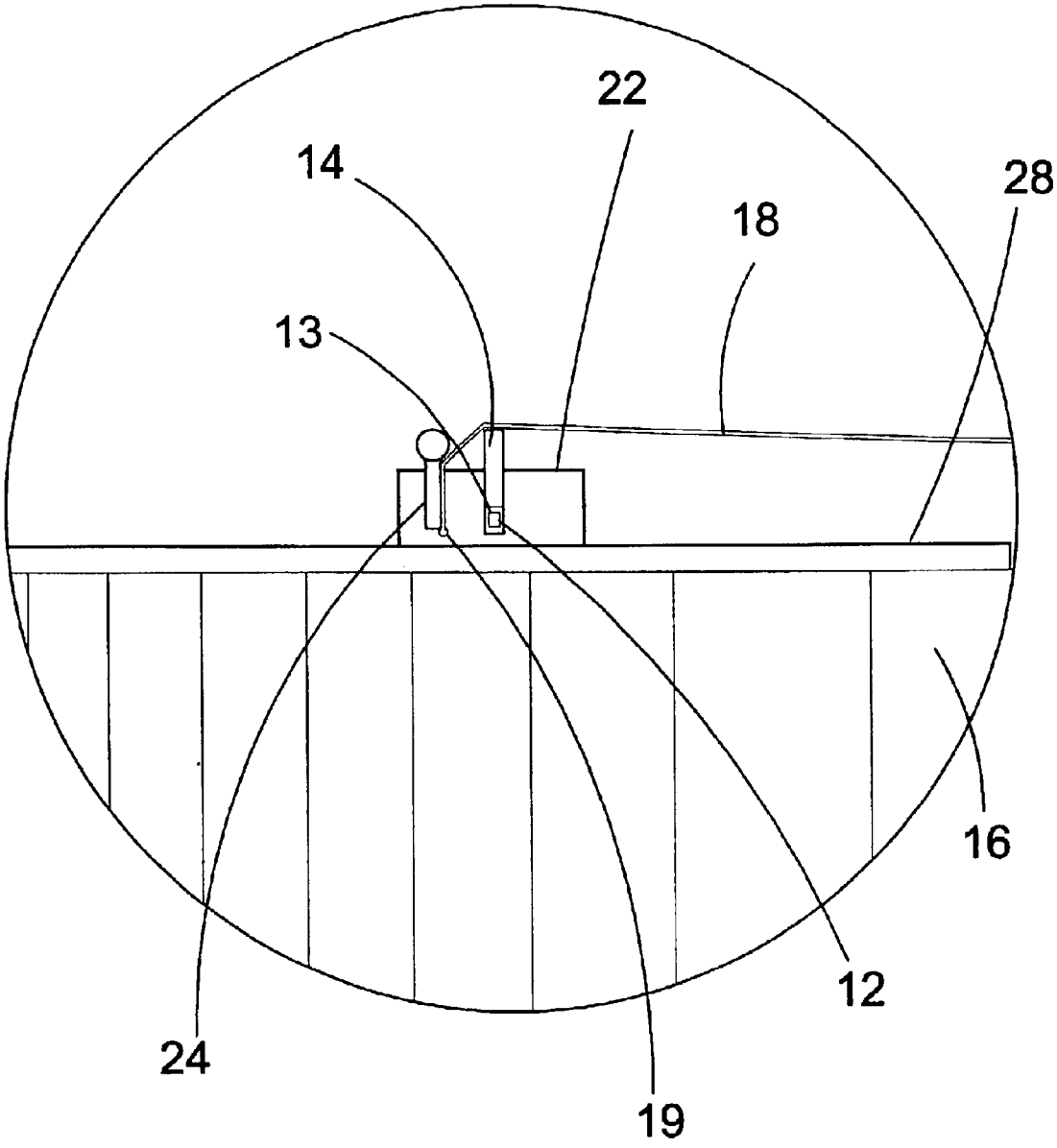
FIG. 8 is a side view of the present invention mounted to a guitar.

Turning to FIG. 8, shown therein is a side view of the device mounted to a guitar using the present invention. Shown above is a side view of the under the saddle pickup (UTS) 13 of the present invention in place under the saddle 14 of an acoustic guitar 16. A piezoelectric element 12 is set in the center, between each pair of strings 18. Also shown are bridge 22, guitar top 28, peg 24 and string ball end 19.

Figure 9:
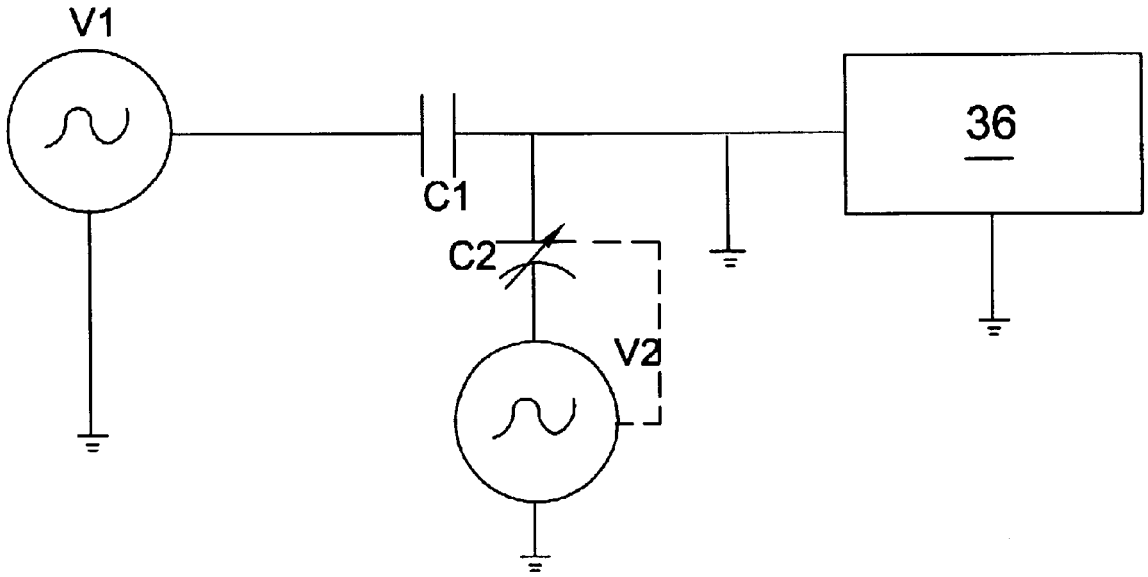
FIG. 9 is a schematic diagram of the present invention.

Turning to FIG. 9, shown therein is a schematic model of the present invention. Shown is the present invention which can be represented by a voltage generator (V1) in series with a capacitor (C1) which is summed with a secondary voltage generator (V2) in series with a capacitor (C2). This secondary voltage system forms a sort of electret microphone which provides ambiance. (C2) is integral with the coaxial cable because it forms an electret system of C2 and V2. The dashed lines represent the interdependency. Preamp 36 is also shown.

Figure 10:
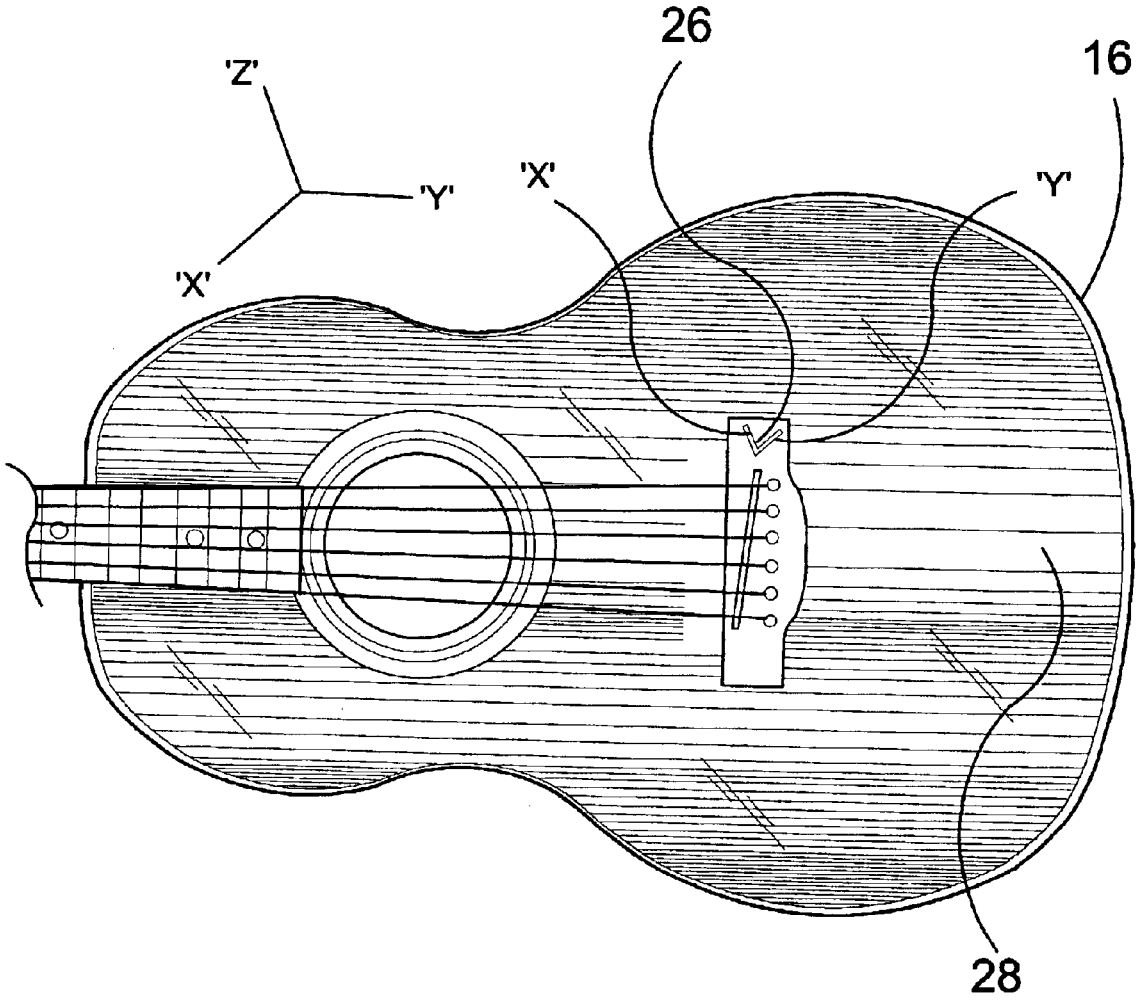
FIG. 10 is an illustrative view of the auxiliary pickup.

Turning to FIG. 10, shown therein is an illustrative view of the auxiliary pickup 56. The acoustic guitar pickup system of the present invention consists of two components, a primary and secondary device; that provide the signal that is representative of the guitar sound. The primary device is designed to detect the bulk of the sound as well as the tonal nuances, but provide minimal ambiance as previously explained. The secondary device makes use of physically induced charge modulation properties along both longitudinal and transverse axis of the interconnecting coaxial cable that runs from the device to the impedance changing preamplifier. The auxiliary pickup 26 adds a "smoother" tonality to the system. It is neither percussive nor ambient. Optional pickup 26 senses the vibrations within the guitar top; i.e., the X-Y plane. The 'Z' axis is perpendicular to the top 28 of the musical instrument 16.

Figure 11:
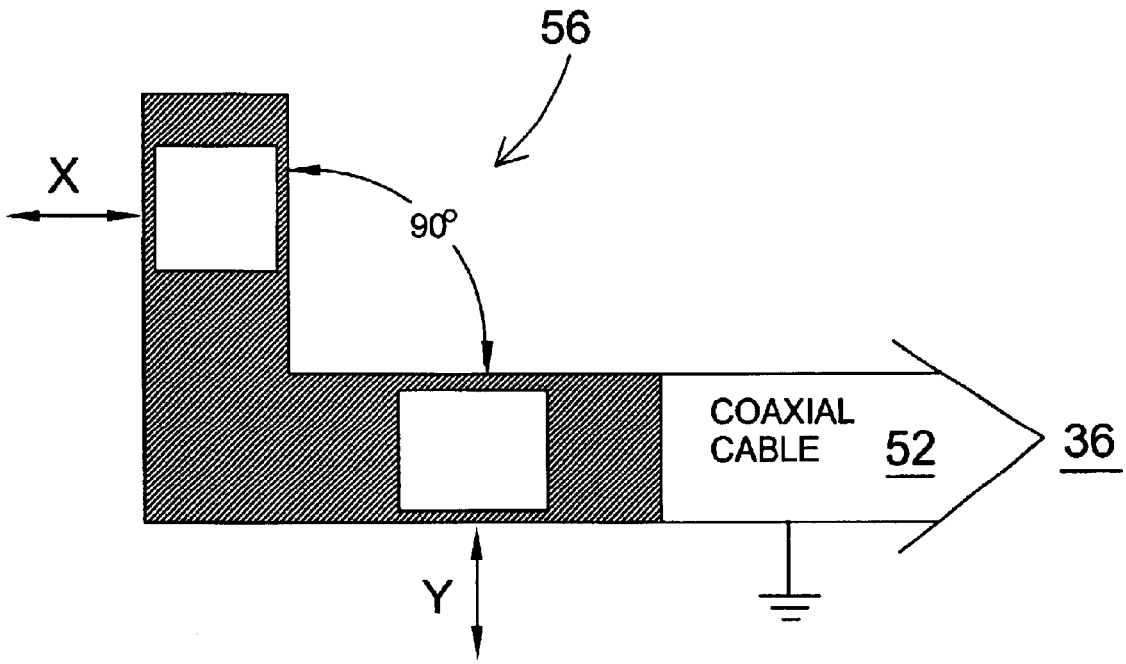
FIG. 11 is a diagram of the auxiliary pickup.

Turning to FIG. 11, shown therein is a diagram of an auxiliary pickup 26. The force directions (X+Y) of the auxiliary pickup lie within the plane of the guitar top, i.e., they are insensitive to vibrational forces perpendicular to the top. Shown are the "X" and "Y" force direction arrows intersecting or interacting with coaxial cable 52 which connects to preamp 36 which is summed with the UTS pickup.

Figure 12:
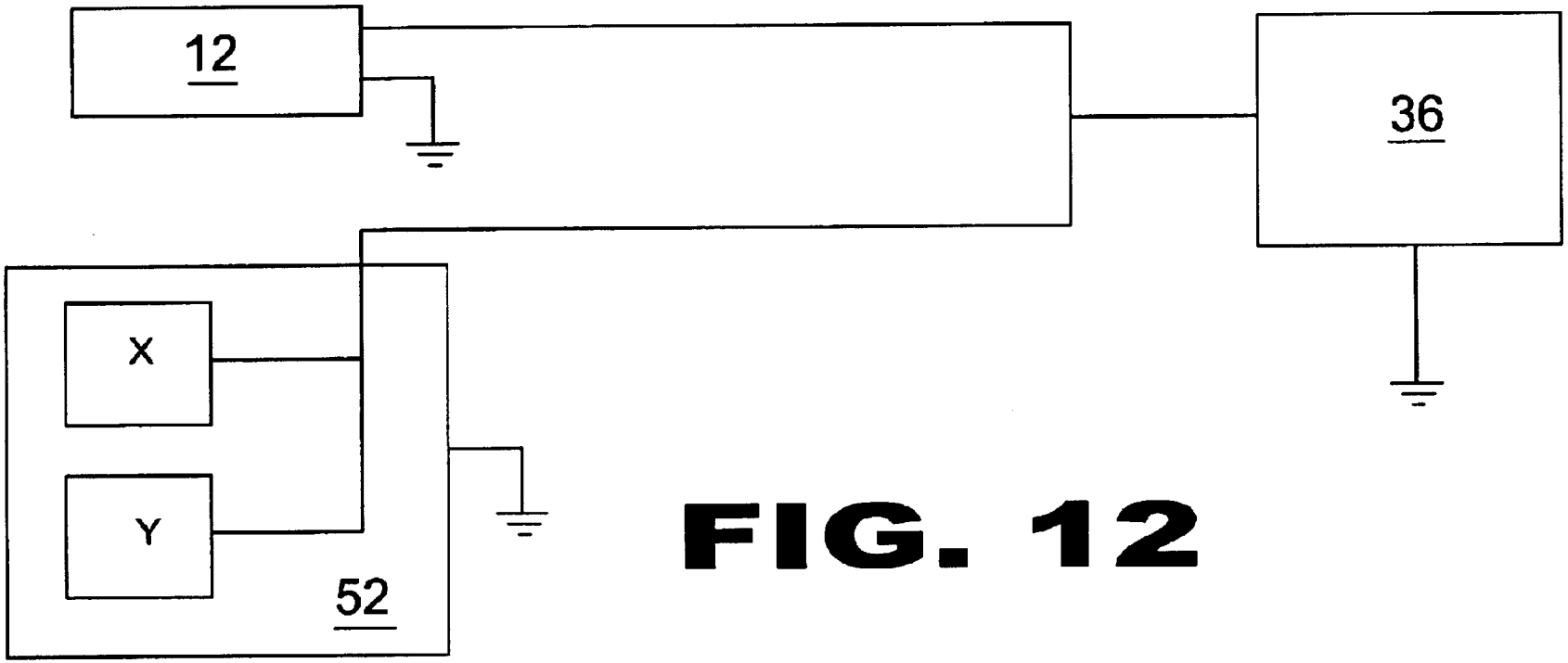
FIG. 12 is a schematic of the auxiliary pickup with the primary.

Turning to FIG. 12, shown therein is a schematic of the secondary pickup 52 attachment with the primary pickup 12. Shown is the auxiliary pickup diagram of the present invention. Also shown is the preamp 36. Also shown are the X and Y components of the secondary 52.

What is claimed is:

1. In a stringed instrument having a generally flat top, the top having a bridge thereon, the bridge having a saddle mounted therein over which a plurality of strings are passed, a pickup which comprises;

a) wherein the saddle has a top portion and a bottom portion, and the pickup has an upper side and a lower side;

b) a plurality of piezoelectric elements being disposed under said bottom of the saddle, wherein one of said piezoelectric elements is disposed between each of the plurality of strings to permit the piezoelectric element to respond to the strings;

c) a plurality of spacers disposed in a side by side relationship with each piezoelectric element so that the response of the piezoelectric elements is changed and the downward force exerted by the strings is not borne by the piezoelectric elements alone;

d) a coaxial cable, said cable having a first end and a second end, said first end being connected to said plurality of piezoelectric elements to form an electrical connection thereto; and, e) an output jack connected to said second end of said coaxial cable to permit connection to an electrical output line.

2. The apparatus of claim 1, wherein said plurality of piezoelectric elements are disposed equidistance between each of the plurality of strings.

3. The apparatus of claim 2, wherein said plurality of piezoelectric elements would number five for use with a six-stringed instrument.

4. The apparatus of claim 3, further comprising at least one additional piezoelectric element wherein at least one additional piezoelectric element is disposed outside at least one string of the plurality of strings.

5. The apparatus of claim 4, further comprising a pair of additional piezoelectric elements wherein said pair of piezoelectric elements are disposed outside the plurality of strings, wherein one piezoelectric element is disposed on each side of the strings.

6. The apparatus of claim 5, wherein each of said pair of piezoelectric elements is disposed outside the plurality of strings a distance equal to one-half the distance between the strings.

7. The apparatus of claim 6, further comprising a compressible gasket disposed between the upper side of the pickup and the saddle to prevent air gaps thereinbetween.

8. The apparatus of claim 7, further comprising a compressible gasket disposed between the lower side of the pickup and the bridge to prevent air gaps thereinbetween.

9. The apparatus of claim 8, further comprising a preamplifier disposed on said second end of said coaxial cable, wherein said preamplifier is disposed between said second end of said coaxial cable and said output jack.

10. The apparatus of claim 9, further comprising a power supply for said preamplifier being disposed on the stringed instrument, wherein said power source is activated during the time a plug is inserted into said output jack.

11. The apparatus of claim 10, wherein each of said piezoelectric elements has a first and a second electrode disposed thereon, further comprising a first electrode integrator connecting each of said first electrodes and a second electrode integrator connecting each of said second electrodes.

12. The apparatus of claim 11, wherein said coaxial cable has a first inner conductor and a second shield conductor, wherein said first inner conductor is connected to said first electrode integrator and said second shield conductor is connected to said second electrode integrator.

13. The apparatus of claim 12, wherein said coaxial cable senses physically induced charge modulation properties along both longitudinal and transverse axis of said coaxial cable so that the signal transmitted to the preamplifier is improved.

14. The apparatus of claim 13, wherein said coaxial cable senses ambient sounds within the stringed instrument so that the signal transmitted to the preamplifier is improved.

15. The apparatus of claim 14, wherein said auxiliary pickup senses vibrations within the X-Y plane of the top of the stringed instrument and insensitive to vibrational forces perpendicular to the top so that the signal transmitted to the preamplifier is improved.

16. The apparatus of claim 15, wherein said piezoelectric elements and said spacers produce a directional coupling between the pickup and the stringed instrument.

17. The apparatus of claim 1 further comprising a downward force compensation compound positioned between the upper side of the pickup and saddle and between the bridge and the lower side of the pickup to prevent air gaps and provide an improved mechanical coupling between the saddle and bridge.

18. The apparatus of claim 1 further comprising a downward force compensation compound positioned between the upper side of the pickup and saddle or between the bridge and the lower side of the pickup to prevent air gaps and provide an improved mechanical coupling between the saddle and bridge.

19. The apparatus of claim 1 further comprising a downward force compensation compound positioned between the upper side of the pickup and saddle to prevent air gaps and provide an improved mechanical coupling between the saddle and bridge.

20. The apparatus of claim 1 further comprising a downward force compensation compound positioned between the bridge and the lower side of the pickup to prevent air gaps and provide an improved mechanical coupling between the saddle and bridge.

21. The apparatus of claim 17, wherein said compound is compressible and does not act as an adhesive, but as a compressible gasket that can be easily removed from the system making the pickup removable as well as replaceable.

22. The apparatus of claim 18, wherein said compound:

a) prevents the mechanical decoupling of the individual piezoelectric elements of the under the saddle pickup;

b) couples the saddle to the bridge with no void thus making the saddle drive the top more evenly resulting in a more even sound; and, c) absorbs some of the harshness due to mechanical noise of the string being actuated by the fingers or a pick.

23. The apparatus of claim 18, wherein the compound:

a) conducts sound;

b) compressible; and c) has memory wherein it returns to original form.

* * * * *